US007090530B1

(12) United States Patent
Dibble

(10) Patent No.: US 7,090,530 B1
(45) Date of Patent: Aug. 15, 2006

(54) QUICK CONNECT ELECTRICAL BOX

(76) Inventor: Howard A. Dibble, 104 Pink Jasmine Ct., Mooresville, NC (US) 28115

( * ) Notice: Subject to any disclaimer, the term of this patent is extended or adjusted under 35 U.S.C. 154(b) by 0 days.

(21) Appl. No.: 11/234,021

(22) Filed: Sep. 22, 2005

(51) Int. Cl.
*H01R 4/24* (2006.01)

(52) U.S. Cl. ..... 439/441; 439/835; 439/535

(58) Field of Classification Search ..... 439/441, 439/835, 535–541.5
See application file for complete search history.

(56) References Cited

U.S. PATENT DOCUMENTS 3,325,768 A * 6/1967 Munroe ..... 439/441
3,885,852 A 5/1975 Grove
4,165,443 A 8/1979 Figart et al.
4,172,628 A * 10/1979 Lingaraju ..... 439/441
4,295,018 A 10/1981 Borrelli
4,924,032 A 5/1990 Akins
5,178,555 A 1/1993 Kilpatrick et al.
5,324,213 A * 6/1994 Frantz ..... 439/441
5,348,496 A * 9/1994 Ludwig ..... 439/441
5,454,730 A * 10/1995 Tozuka ..... 439/438
5,471,012 A 11/1995 Opel
5,525,754 A 6/1996 Akins
5,685,735 A * 11/1997 Hohorst ..... 439/441
5,726,385 A * 3/1998 Lowery et al. ..... 174/50
5,915,991 A * 6/1999 Roman ..... 439/441
5,993,245 A * 11/1999 Osada ..... 439/441
6,007,369 A * 12/1999 Kennedy et al. ..... 439/441
6,010,347 A * 1/2000 Lee ..... 439/222
6,012,944 A * 1/2000 Hatakeyama ..... 439/441
6,056,585 A * 5/2000 Hatakeyama et al. ..... 439/441
6,074,241 A * 6/2000 Patel et al. ..... 439/441
6,080,008 A * 6/2000 Frantz ..... 439/441
6,126,494 A * 10/2000 Fuchs et al. ..... 439/835
6,146,186 A * 11/2000 Barrat et al. ..... 439/410
6,146,187 A * 11/2000 Pallai ..... 439/441
6,201,187 B1 3/2001 Burbine
6,244,904 B1 * 6/2001 Fabian et al. ..... 439/656
6,261,120 B1 * 7/2001 Beege et al. ..... 439/441
6,280,233 B1 * 8/2001 Beege et al. ..... 439/441
6,428,343 B1 * 8/2002 Landis et al. ..... 439/441
6,558,190 B1 5/2003 Pierson, Jr.
6,767,245 B1 7/2004 King
6,774,308 B1 8/2004 Troyen
6,786,766 B1 * 9/2004 Chopra ..... 439/535
6,796,855 B1 * 9/2004 Fricke et al. ..... 439/835
6,814,608 B1 * 11/2004 Kollmann ..... 439/441
6,832,938 B1 * 12/2004 Lenker ..... 439/835
6,863,561 B1 * 3/2005 Gorman ..... 439/535
6,870,099 B1 3/2005 Schultz et al.
6,884,111 B1 4/2005 Gorman
6,893,286 B1 * 5/2005 Drewes et al. ..... 439/441

(Continued)

*Primary Examiner*—Ross Gushi
(74) *Attorney, Agent, or Firm*—Nicole E. Coppes-Gathy

(57) ABSTRACT

The quick connect electrical box comprises a first member having side walls and a back wall defining an interior and an exterior. The back wall has an opening configured to receive an electrical wire and a slot configured to receive a removing device. The first member has ports configured to receive electrical cables containing a plurality of the electrical wires. The quick connect electrical box also comprises a second member matingly attached to the back wall of the first member. The second member has side walls and a back wall defining an interior and an exterior. The back wall has an electrical clip including a body, an attachment flange, and a connection platform. The connection platform has a support wall and a branch having a fin with a notch configured to receive and retain the electrical wire.

10 Claims, 3 Drawing Sheets

U.S. PATENT DOCUMENTS 6,911,602 B1 * 6/2005 Conrad ..... 174/68.2
2001/0002349 A1 * 5/2001 Jaag ..... 439/835
2001/0010981 A1 * 8/2001 Cutler et al. ..... 439/441
2002/0187670 A1 * 12/2002 Cisey ..... 439/441
2003/0194918 A1 * 10/2003 Fricke et al. ..... 439/835
2004/0116001 A1 * 6/2004 Lenker ..... 439/835

* cited by examiner

QUICK CONNECT ELECTRICAL BOX

BACKGROUND

Electrical (or junction) boxes, used for making electrical connections between various devices are well established in the art of electrical wiring. Conventional electrical boxes are generally plastic or metal and have several ports for receiving electrical cables and service cables. Electrical cables are fed into the electrical box and connected with the service cable. An electrical cable wire is connected to the corresponding service cable wire by twisting the wires together and securing them with a screw-type twist connector (or wire nut).

The connection of the wires with the twist connector is labor intensive. Unfortunately, using conventional methods it is easy for a user to make a wrong connection, which can be dangerous.

Additionally, conventional boxes are not large enough to support all of the wires and twist connectors utilized. Therefore, after all of the appropriate connections are made, the user will have to press all the wires and twist connectors back inside the box. This leaves the box in a disheveled state making it difficult to make an easy, quick repair, in the future.

What is needed in the art is an electrical box that is easy to use by safely coupling wires together, can be used for connecting all standard electrical connections, and results in the interior wires being neat and organized for future use.

SUMMARY

The disclosure is directed to a quick connect electrical box. The quick connect electrical box comprises a first member having side walls and a back wall defining an interior and an exterior. The back wall has an opening configured to receive an electrical wire and a slot configured to receive a removing device. The first member has ports configured to receive electrical cables containing a plurality of the electrical wires. The quick connect electrical box also comprises a second member matingly attached to the back wall of the first member. The second member has side walls and a back wall defining an interior and an exterior. The back wall has an electrical clip including a body, an attachment flange, and a connection platform. The connection platform has a support wall and a branch having a fin with a notch configured to receive and retain the electrical wire.

The disclosure is also directed to an electrical clip. The electrical clip comprises a body having an attachment flange and a connection platform. The connection platform has a support wall and a branch having a fin with a notch configured to receive and retain an electrical wire.

A method of using a quick connect electrical box is also disclosed. The method comprises disposing an electrical cable into a port of first member of the quick connect electrical box. The electrical cable contains a plurality of electrical wires. The first member has side walls and a back wall defining an interior and an exterior. The back wall has an opening configured to receive the electrical wire and a slot configured to receive a removing device. The method also comprises aligning the electrical wire with the opening and exerting force on the electrical wire to insert the electrical wire into the opening. Lastly, the method comprises feeding the electrical wire into an electrical clip of a second member matingly attached to the back wall of the first member. The second member has side walls and a back wall defining an interior and an exterior. The back wall comprises the electrical clip including a body, an attachment flange, and a connection platform. The connection platform has a support wall and a branch having a fin with a notch configured to receive and retain the electrical wire.

The method also comprises inserting the removing device into the slot, exerting force on the removing device to depress the fin, pulling on the electrical wire to release the electrical wire from the fin and removing the electrical wire from the opening.

BRIEF DESCRIPTION OF THE FIGURES

Referring now to the figures, wherein like elements are numbered alike.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

The present invention is a quick connect electrical box that provides the user with an easy means for connecting electrical cables and service cables. The quick connect electrical box identifies the correct location for the ground, power and common wires, while providing a secure and safe connector to create the electrical connection as well as holding the wire in place. Additionally, the quick connect electrical box provides an easy means for releasing the wire. The quick connect electrical box is a standard size and allows for organized placement of internal wires.

Figure 1:
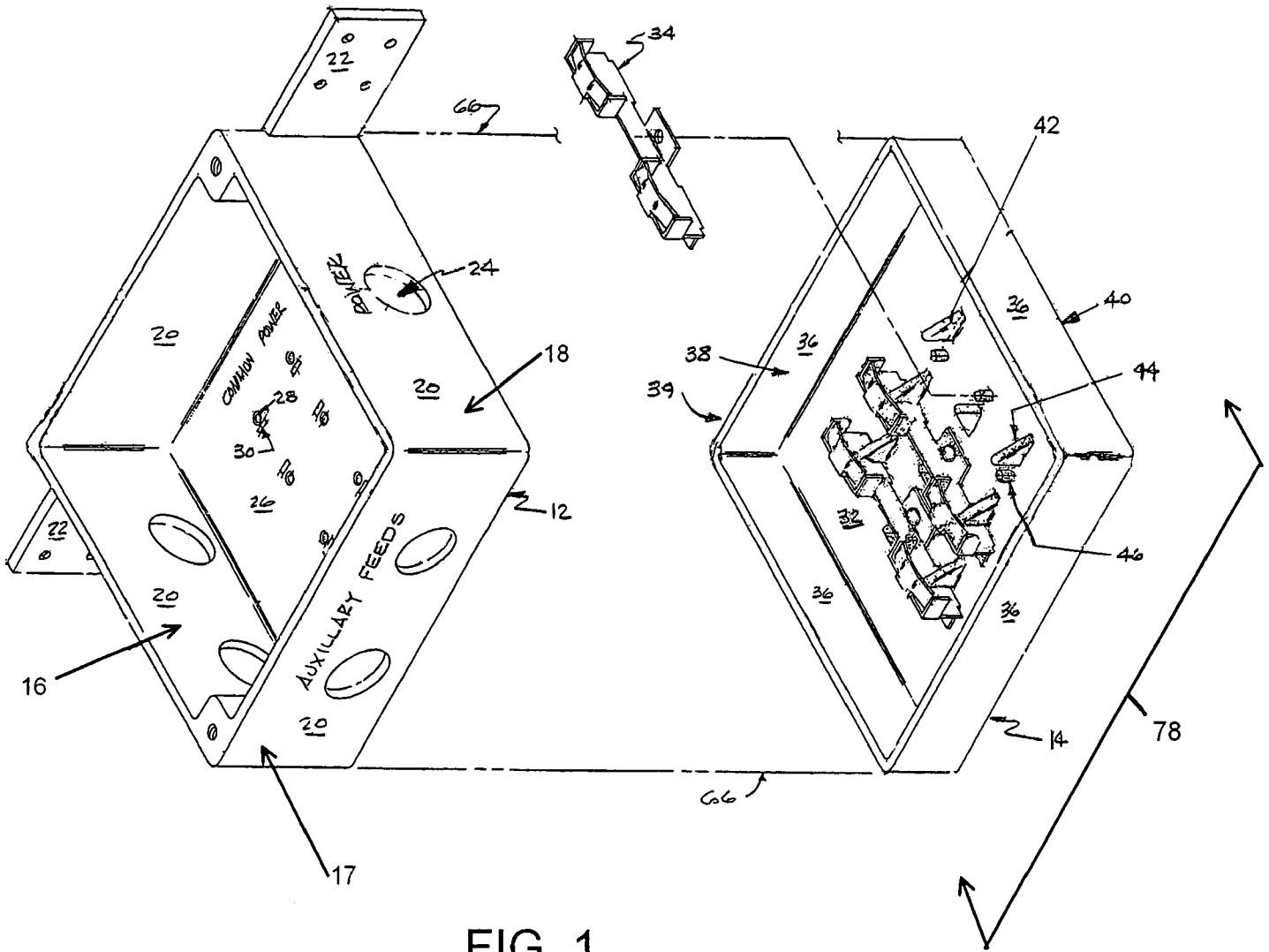
FIG. 1 is an exploded view of an exemplary embodiment of the quick connect electrical box illustrating the first member and the second member.

Referring to FIG. 1, an exemplary quick connect electrical box 10 is illustrated in an exploded view. The quick connect electrical box 10 includes a first member 12 and a second member 14. The first member 12 is a box having four side walls 20 and a back wall 18 that define an interior portion 16 and an exterior 17. The second member 14 is configured to matingly attach to the first member 12, as will be described further herein.

The quick connect electrical box 10 can be attached to the stud of a wall with connector 22. The means of connecting the box to the wall is dependent upon the type of box utilized.

Electrical and service cables are disposed into the interior 16 of the quick connect electrical box 10 through port (or cut-out) 24. Although six cut-outs are illustrated, any number can be utilized, depending upon the size of the quick connect electrical box 10 and upon the needs of the user. The appropriate number of cut-outs 24 can be removed and the electrical or service cables can be disposed into the interior of the first member 12. Several electrical cables can be utilized, depending upon the needs of the user. Prior to installation, the user strips the covering from the cable to reveal the electrical wires. Each wire is appropriately stripped of the insulation for connection to the quick connect electrical box 10.

The interior portion 16 has an interior side 26 to back wall 18. The interior side 26 has openings 28 and slots 30 that extend through the interior side 26 to the exterior 17. Although three columns of four openings 28 and four slots 30 are illustrated, any number of openings 28 and slots 30 may be utilized as long as each opening 28 is paired with a slot 30. The openings 28 are adapted to receive electrical wires for connection to the electrical clip 34 located in interior side 32 of the second member 14. The slots 30 are configured to receive a flat head screw driver, or similar device, in order to release an electrical wire from the electrical clip, as will be described further herein.

The second member 14 is a box that is defined by four walls 36 and a back wall 40 that define an interior portion 38 and an exterior 39. The interior portion 38 has an interior side 32 to back wall 40. Electrical clips 34 are located on interior side 32 of the second member 14. The electrical clips 34 can be attached to the interior side 32 by use of a fastener (not shown) such as a screw, and the like. In a preferred embodiment, the electrical clips 34 can be attached to the interior side 32 by use of locating stops (or stiffeners or retainers) 42, 44 and locating pins 46. For final installation, the locating pins 46 would be heat swedged to retain the electrical clips in place.

Figure 2:
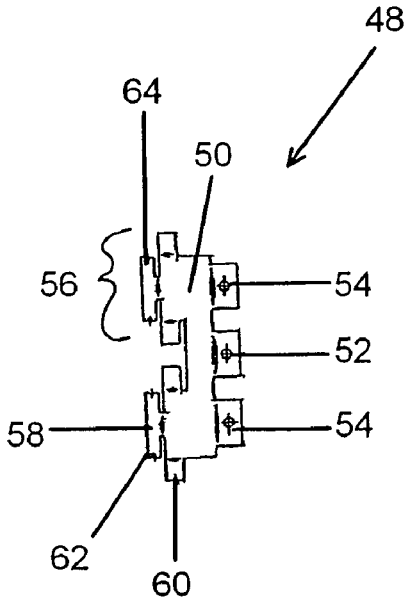
FIG. 2 is an illustration of a stamp pattern for an exemplary embodiment of the electrical clip.
Figure 3:
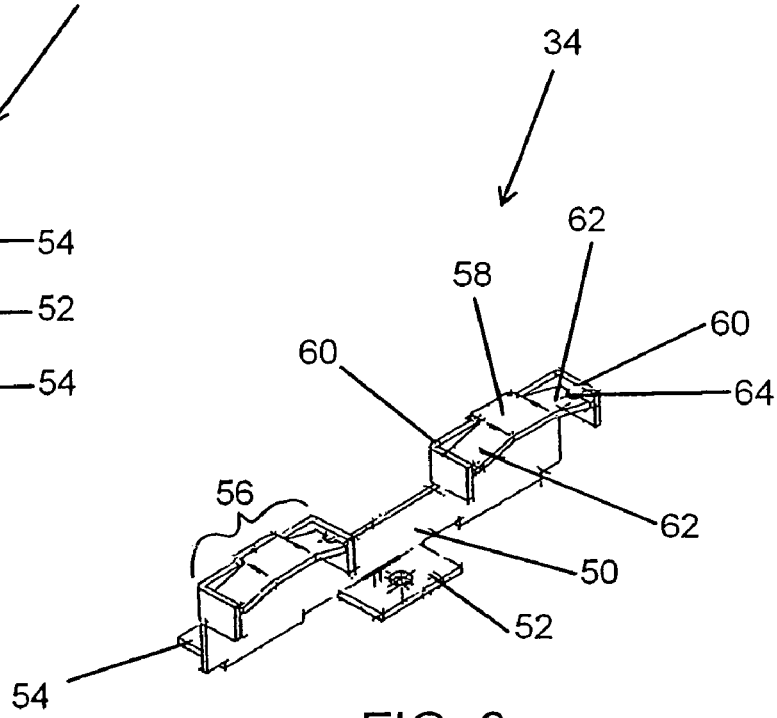
FIG. 3 is an illustration of a fully assembled exemplary embodiment of the electrical clip.

Referring now to FIGS. 2 and 3, a fully assembled electrical clip 34 is illustrated with a stamp pattern 48 for the electrical clip 34. The electrical clip 34 has a body 50 having attachment flanges 52, 54 and connection platforms 56. Although two connection platforms 56 are illustrated, the present invention contemplates having one connection platform 56, two connection platforms 56, three connection platforms 56, or any number of connection platforms 56, depending upon the size of the electrical box 10. The electrical clip attaches to the interior side 32 with the attachment flanges 52, 54. To ensure a secure connection and to support the electrical clip 34 when force is applied, the attachment flange 52 is disposed on an opposite side of body 50 from attachment flanges 54. Although three attachment flanges 52, 54 are illustrated, any number of attachment flanges may be utilized, depending upon the size and type of electrical clip 34.

Connector platforms 56 are connected to, and when formed are atop body 50. Each connector platform 56 has stabilizing walls 60 and a branch 58 having two fins 62. The fins 62 have a notch 64 that is configured to receive an electrical wire (not shown). The electrical wire is forced through the notch 64 depressing fin 62. Following insertion of the wire, the spring tension from fin 62 retains the wire in place making the appropriate electrical connection. The electrical wire can be released from fin 62 by depressing with a flat head screwdriver on fin 62, as will be described further herein. Although two connector platforms 56 are illustrated, the electrical clip 34 can have any number of connector platforms 56, depending upon the size and type of electrical clip 34.

The electrical clip 34 can be manufactured of any material that is sturdy enough to hold an electrical wire in place and resilient enough to be able to release the electrical wire. The electrical clip 34 must be comprised of a material that conducts electricity. The material utilized may include, but is not limited to, brass.

As illustrated with lines 66 in FIG. 1, the quick connect electrical box 10 is complete when the second member 14 is matingly attached to the first member 12. The two members 12, 14 can be secured to each other by an adhesive, a clip, a fastener, or heat sealed.

The quick connect electrical box 10 is of standard size. Conventional electrical boxes can have a depth of about 1.5 inches to about 3.75 inches. In this embodiment, so as to not exceed the above depths of the quick connect electrical box 10, the first member 12 can have a depth of about 0.75 inches while the second member 14 can have a depth of about 2 inches to about 2.5 inches. The quick connect electrical box 10 can be manufactured of plastic and the like. The type of electrical box (e.g., junction boxes, single outlet boxes, two-gang, three-gang, four-gang, and the like) utilized depends upon the needs of the user.

Figure 4:
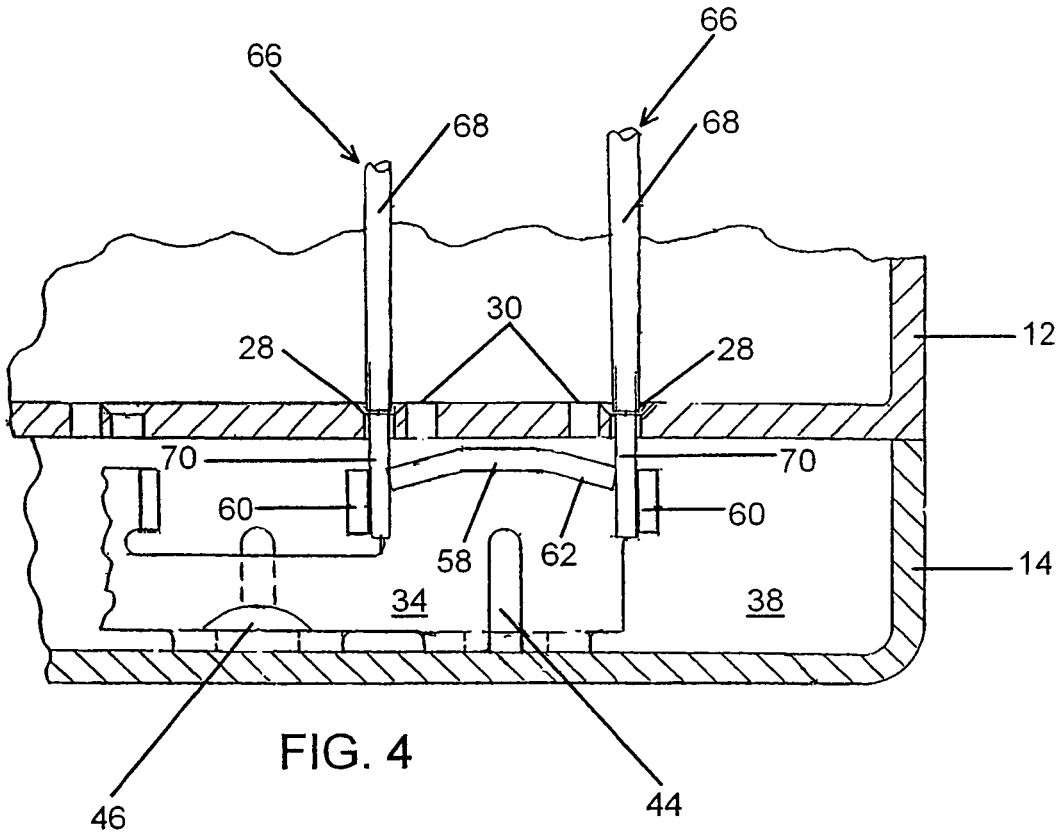
FIG. 4 is a cross sectional view of FIG. 1 taken along line 78 illustrating wires disposed in the exemplary embodiment of the electrical clip.
Figure 5:
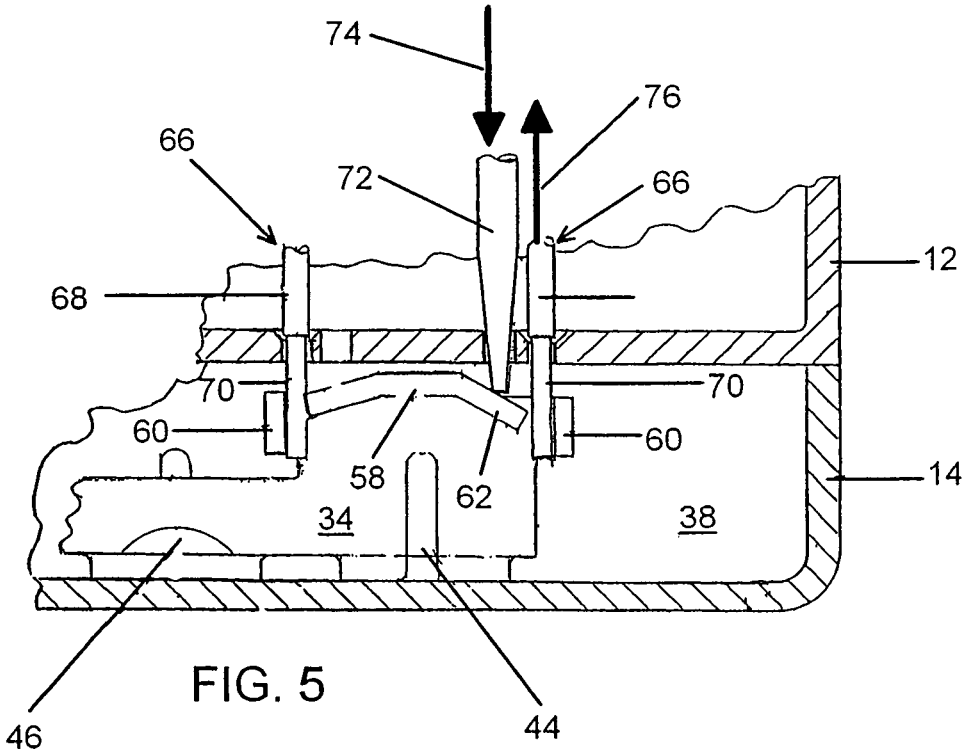
FIG. 5 is a cross sectional view of FIG. 1 taken along line 78 illustrating using a device to remove a wire disposed in the exemplary embodiment of the electrical clip.

The quick connect electrical box 10 can be easily used by a skilled electrician or even an unskilled homeowner. Special care must be taken by all users of the quick connect electrical box 10 to ensure safe practices when dealing with live wires. FIGS. 4 and 5 illustrate a cross sectional view taken along line 78 in FIG. 1.

Installation of electrical sources to the quick connect electrical box 10 is simple. A user disposes a power source, stripped of protective insulation, into the quick connect electrical box 10 through cut-outs 24. The power source is separated into three electrical wires (ground, common, and power). The user can easily determine the proper location for the electrical wires by reading the labels disposed adjacent to the openings 28. The labels (e.g., common, power, and ground) can be stickers, embossed lettering, and the like. Any labeling scheme is contemplated, as long as the openings 28 are properly and consistently labeled.

As illustrated in FIG. 4, each complete wire 66 is encased in insulation 68 and for proper connection must be stripped of insulation to reveal the wire 70. The wire 70 is then inserted into the appropriate openings 28 of the first member 12. As illustrated in FIG. 4, the wire 70 exits the opening 28 into the interior portion 38 of the second member 14 and interacts with the electrical clip 34. The wire 70 is directed to fin 62 and into notch 64. The force of the incoming wire 70 depresses fin 62 and, when the force is removed, fin 62 and notch 64 hold the wire 70 in place by spring tension. Thus, the wire 70 creates the appropriate electrical connection with the appropriately positioned electrical wires of the auxiliary or other feeds. The preceding procedure is repeated for the installation of any number of auxiliary feeds or switches that the box can support.

In the instance when a wire has to be removed from the quick connect electrical box 10, the procedure is very simple, as illustrated in FIG. 5. A user disposes a flat head screw driver (or other appropriately shaped device) 72 into the desired slot 30 of the first member 12, as illustrated with arrow 74. The device 72 would force down the fin 62 holding the wire 70, allowing the user to remove the wire 70 from the electrical clip 34, as illustrated with arrow 76. As is readily understood, the user can easily reinstall any wire into the electrical clip 34 as needed. The preceding procedure is repeated for the removal of any number of electrical wires properly installed in the quick connect electrical box 10.

The quick connect electrical box is specially designed to be easily manipulated by anyone, including skilled electricians or homeowners. The quick connect electrical box is more efficient than conventional electrical boxes since installation of the electrical wires is easier using the catch and release function of the electrical clip. The quick connect electrical box also helps to organize the electrical wires in the box by labeling the appropriate junctions. Further, there is no longer any need for twist connectors and snarled wires, since the design of the quick connect electrical box lends itself to organized placement of wires.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A quick connect electrical box comprising:

a first member having side walls and a back wall defining an interior and an exterior, said back wall having at least one opening configured to receive an electrical wire and at least one slot configured to receive a removing device, said first member having ports configured to receive electrical cables containing a plurality of said electrical wire; and a second member matingly attached to said back wall of said first member, said second member having side walls and a back wall defining an interior and an exterior, said back wall having at least three electrical clips, each said electrical clip including a body, at least one attachment flange, and at least one connection platform, said at least one connection platform having at least one support wall and a branch having at least one fin with a notch configured to receive and retain said electrical wire.

2. The quick connect electrical box of claim 1, wherein said first member and said second member are attached by at least one of an adhesive and heat sealing.

3. The quick connect electrical box of claim 1, wherein said electrical clip comprises brass.

4. The quick connect electrical box of claim 1, wherein said first member and said second member comprise a plastic material.

5. The quick connect electrical box of claim 1, wherein a depth of the quick connect electrical box is about 1.5 inches to about 3.75 inches.

6. The quick connect electrical box of claim 1, further comprising:

labels disposed on said back wall of said first member to identify the appropriate location for insertion of said electrical wire in said at least one opening.

7. The quick connect electrical box of claim 1, wherein said removing device is a flat head screwdriver.

8. A method of using a quick connect electrical box comprising:

inserting an electrical cable into a port of first member of the quick connect electrical box, said electrical cable containing a plurality of electrical wires, said first member having side walls and a back wall defining an interior and an exterior, said back wall having at least one opening configured to receive an electrical wire and at least one slot configured to receive a removing device; and aligning said electrical wire with said opening, exerting force on said electrical wire to insert said electrical wire into said opening; and feeding said electrical wire into an electrical clip of a second member matingly attached to said back wall of said first member, said second member having side walls and a back wall defining an interior and an exterior, said back wall comprising said electrical clip including a body, at least one attachment flange, and at least one connection platform, said at least one connection platform having at least one support wall and a branch having at least one fin with a notch configured to receive and retain said electrical wire.

9. The method of claim 8, further comprising:

inserting said removing device into said slot;

exerting force on said removing device to depress said fin;

pulling on said electrical wire to release said electrical wire from said fin; and removing said electrical wire from said opening.

10. The method of claim 8, wherein said removing device is a flat head screwdriver.

* * * * *